US007369804B2

(12) United States Patent
Yasuda et al.

(10) Patent No.: US 7,369,804 B2
(45) Date of Patent: May 6, 2008

(54) FIXING DEVICE

(75) Inventors: Akihiro Yasuda, Osaka (JP); Masaru Imai, Osaka (JP); Noriyuki Tajima, Osaka (JP); Keisuke Fujimoto, Osaka (JP); Hideaki Yamada, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 57 days.

(21) Appl. No.: 10/575,353

(22) PCT Filed: Oct. 6, 2004

(86) PCT No.: PCT/JP2004/014753

§ 371 (c)(1),
(2), (4) Date: Apr. 11, 2006

(87) PCT Pub. No.: WO2005/038535

PCT Pub. Date: Apr. 28, 2005

(65) Prior Publication Data

US 2007/0014599 A1 Jan. 18, 2007

(30) Foreign Application Priority Data

Oct. 17, 2003 (JP) ..... 2003-358023

(51) Int. Cl.
*G03G 15/20* (2006.01)

(52) U.S. Cl. ..... 399/330; 399/328

(58) Field of Classification Search ..... 399/33, 399/328, 329, 330, 333; 219/619
See application file for complete search history.

(56) References Cited

U.S. PATENT DOCUMENTS 6,453,144 B1 * 9/2002 Sato ..... 399/328
6,687,481 B2 * 2/2004 Watanabe et al. ..... 399/328
6,963,718 B2 * 11/2005 Sekiguchi ..... 399/328
2002/0031380 A1 3/2002 Sato (Continued)

FOREIGN PATENT DOCUMENTS

JP 10-074009 3/1998

(Continued)

OTHER PUBLICATIONS

English Language Abstract of JP 10-074009.

(Continued)

*Primary Examiner*—Sandra L. Brase
(74) *Attorney, Agent, or Firm*—Greenblum & Bernstein, P.L.C.

(57) ABSTRACT

A fixing apparatus can prevent an excessive rise in temperature of a paper non-passage area due to diverted flow of magnetic flux from a paper passage area of a heat-producing element to a paper non-passage area thereof has a small configuration. A center core is rotated by a rotation section, bringing cutaway parts to a magnetic path masking position, and the degree of magnetic coupling between the center core and a heat-producing roller is weakened, suppressing an excessive rise in temperature of paper non-passage areas of the heat-producing roller. With this fixing apparatus, switching of the intensity of magnetic coupling between the center core and heat-producing roller can be performed simply by rotating the center core. Also, with this fixing apparatus, it is not necessary for magnetism suppressing elements to be provided as separate members, enabling the configuration to be made simpler and less expensive.

20 Claims, 13 Drawing Sheets

U.S. PATENT DOCUMENTS

| | | | |
|---|---|---|---|
| 2003/0077093 | A1 | 4/2003 | Sekiguchi et al. |
| 2003/0086736 | A1 | 5/2003 | Sekiguchi et al. |
| 2005/0199613 | A1 | 9/2005 | Samei et al. |
| 2005/0201768 | A1 | 9/2005 | Tatematsu et al. |
| 2006/0072931 | A1 | 4/2006 | Asakura et al. |
| 2006/0099001 | A1 | 5/2006 | Asakura et al. |

FOREIGN PATENT DOCUMENTS

| | | |
|---|---|---|
| JP | 2000-162913 | 6/2000 |
| JP | 2000-181258 | 6/2000 |
| JP | 2001-125407 | 5/2001 |
| JP | 2002-083676 | 3/2002 |
| JP | 2003-107941 | 4/2003 |
| JP | 2003-123957 | 4/2003 |
| JP | 2003-123961 | 4/2003 |

OTHER PUBLICATIONS

English Language Abstract of JP 2003-123961.
English Language Abstract of JP 2003-123957.
English Language Abstract of JP 2002-083676.
English Language Abstract of JP 2000-181258.
English Language Abstract of JP 2003-107941.
English Language Abstract of JP 2000-162913.
U.S. Appl. No. 10/575,356 to Yasuda et al., filed Apr. 11, 2006.
U.S. Appl. No. 10/565,270 to Yasuda et al., filed Apr. 11, 2006.
U.S. Appl. No. 10/576,307 to Samei et al., filed Apr. 11, 2006.
English language Abstract and partial translation of JP 2001-125407.

* cited by examiner

FIXING DEVICE

TECHNICAL FIELD

The present invention relates to a fixing apparatus useful for employment in an image forming apparatus such as an electrophotographic or electrostatographic copier, facsimile machine, or printer, and more particularly to a fixing apparatus that heat-fixes an unfixed image onto a recording medium using an induction heating type of heating section.

BACKGROUND ART

An induction heating (IH) type of fixing apparatus generates an eddy current through the action of a magnetic field generated by a magnetic field generation section in a heat-producing element, and heat-fixes an unfixed image on a recording medium such as transfer paper or an OHP sheet through Joule heating of the heat-producing element by means of the eddy current.

An advantage of this induction heating type of fixing apparatus compared with a heat roller type of fixing apparatus that uses a halogen lamp as a heat source is that heat production efficiency is higher and the fixing speed can be increased.

With a fixing apparatus that uses a thin heat-producing element comprising a thin sleeve or endless belt as the heat-producing element, the thermal capacity of the heat-producing element is low and the heat-producing element can be made to produce heat in a short time, enabling startup responsiveness until heat production at a predetermined fixing temperature to be markedly improved.

On the other hand, with a fixing apparatus that uses this kind of heat-producing element of low thermal capacity, heat is lost simply through the passage of a recording medium, causing a drop in the temperature of the paper passage area. Therefore, with this kind of fixing apparatus, the heat-producing element is heated in a timely fashion so that the temperature of the paper passage area is maintained at a predetermined fixing temperature.

Consequently, with a fixing apparatus that uses this kind of heat-producing element of low thermal capacity, if recording media of small size are fed through continuously, the heat-producing element is continuously heated, and a phenomenon whereby the temperature of a paper non-passage area becomes abnormally higher than the temperature of a paper passage area—that is, a phenomenon of an excessive rise in temperature of a paper non-passage area—occurs.

A known technology for eliminating this kind of phenomenon of an excessive rise in temperature of a paper non-passage area is one whereby, of the magnetic flux generated by a magnetic flux generation section that performs induction heating of the heat-producing element, only magnetic flux that acts on a paper non-passage area of the heat-producing element is absorbed by a magnetic flux absorption member capable of moving in the heat production width direction of the heat-producing element (see, for example, Patent Document 1).

Another known technology for eliminating the phenomenon of an excessive rise in temperature of a paper non-passage area is one whereby a second core of magnetic material corresponding to a paper non-passage area is positioned at the rear of a first core of magnetic material of a magnetic flux generation section that causes heat generation of a heat-producing element by electromagnetic induction, and the lengthwise temperature distribution of the heat-producing element is changed by varying the gap between the first core of magnetic material and second core of magnetic material (see, for example, Patent Document 2).

FIG. 1 is a schematic oblique drawing of a sample implementation of a fixing apparatus disclosed in Patent Document 1. As shown in FIG. 1, this fixing apparatus is provided with a coil assembly 10, a metal sleeve 11, a holder 12, a pressure roller 13, a magnetic flux masking shield 31, a displacement section 40, and so forth.

In FIG. 1, coil assembly 10 generates a high-frequency magnetic field. Metal sleeve 11 is heated by an induction current induced by an induction coil 18 of coil assembly 10, and rotates in the direction of transportation of recording material 14. Coil assembly 10 is supported inside holder 12. Holder 12 is fixed to a fixing unit frame (not shown) and does not rotate. Pressure roller 13 rotates in the direction of transportation of recording material 14 while pressing against metal sleeve 11 and forming a nip area. By having recording material 14 gripped and transported by means of this nip area, an unfixed image on recording material 14 is heat-fixed to recording material 14 by metal sleeve As shown in FIG. 1, magnetic flux masking shield 31 exhibits an arc-shaped curved surface that mainly covers the upper half of induction coil 18, and is advanced and withdrawn with respect to the gap between both ends of coil assembly 10 and holder 12 by means of displacement section 40. Displacement section 40 has a wire 33 linked to magnetic flux masking shield 31, a pair of pulleys 36 on which wire 33 is suspended, and a motor 34 that rotates one of the pulleys 36.

When the size of recording material 14 is the maximum size, magnetic flux masking shield 31 is moved by means of displacement section 40 so as to be withdrawn into the position shown by the solid line in FIG. 1. On the other hand, when the size of recording material 14 is small, magnetic flux masking shield 31 is moved so as to advance into the position shown by the dot-dot-dash line in FIG. 1. By this means, magnetic flux reaching a paper non-passage area of metal sleeve 11 from induction coil 18 is masked, and an excessive rise in temperature of a paper non-passage area is suppressed.

FIG. 2 shows schematic cross-sectional views of a sample implementation of a fixing apparatus disclosed in Patent Document 2. As shown in FIG. 2, this fixing apparatus is provided with a heating assembly 51, a holder 52, a core-holding rotating member 53, an exciting coil 54, a first core 55, a second core 56, a fixing roller 57, a pressure roller 58, and so forth.

In FIG. 2, heating assembly 51 is composed of holder 52, core-holding rotating member 53, exciting coil 54, first core 55, and second core 56, and generates magnetic flux. Fixing roller 57 is induction-heated through the action of magnetic flux generated by heating assembly 51, and rotates in the direction of transportation of recording material 59.

Pressure roller 58 rotates in the direction of transportation of recording material 59 while pressing against fixing roller 57 and forming a nip area. By having recording material 59 gripped and transported by means of this nip area, an unfixed image on recording material 59 is heat-fixed to recording material 59 by heated fixing roller 57.

First core 55 has the same width as the width of the maximum paper passage area of fixing roller 57. When the size of recording material 59 is the maximum size, second core 56 is moved to a position close to first core 55, as shown in FIG. 2A. On the other hand, when the size of recording material 59 is small, core-holding rotating member 53 rotates through 180° and second core 56 is moved to a position away from first core 55, as shown in FIG. 2B. By this means, heat production of a paper non-passage area of fixing roller 57 corresponding to second core 56 is suppressed.

Patent Document 1: Unexamined Japanese Patent Publication No. HEI10-74009

Patent Document 2: Unexamined Japanese Patent Publication No. 2003-123961

DISCLOSURE OF INVENTION

PROBLEMS TO BE SOLVED BY THE INVENTION

However, as the former fixing apparatus has a configuration whereby magnetic flux masking shield 31 is advanced and withdrawn with respect to the gap at either end of coil assembly 10 and holder 12 by means of displacement section 40, there is a problem in that the pair of pulleys 36 of displacement section 40 project greatly from either end of holder 12, as shown in FIG. 1, and the body of the fixing apparatus is correspondingly large.

Furthermore, as shown in FIG. 1, the former fixing apparatus has a configuration whereby magnetic flux masking shield 31 is positioned between metal sleeve 11 and induction coil 18. In a fixing apparatus that uses induction heating, it is necessary to keep the gap between induction coil 18 and metal sleeve 11 narrow—on the order of 1 mm, for example—and increase magnetic coupling. It is necessary for magnetic flux masking shield 31 to be made thin in order to be inserted in this narrow gap. That is to say, there is a problem of electrical resistance increasing because magnetic flux masking shield 31 cannot be made sufficiently thick, and of magnetic flux masking shield 31 tending to produce heat itself. Although heat production due to eddy currents can be suppressed by forming through-holes 35 in magnetic flux masking shield 31, magnetic flux reaches metal sleeve 11 as a result, and a paper non-passage area of the metal sleeve produces heat. As a result, there is a problem in that when small-sized recording material 14 is fed through continuously, heat is accumulated in a paper non-passage area of metal sleeve 11, and an excessive rise in temperature cannot be suppressed.

Also, as shown in FIG. 2A and FIG. 2B, in the latter fixing apparatus the distance between first core 55 and fixing roller 57 does not vary even though second core 56 is displaced with respect to first core 55 by the rotation of core-holding rotating member 53, and therefore the magnetic gap between a paper passage area and paper non-passage area of fixing roller 57 is fixed.

Consequently, with this fixing apparatus, diverted flow of magnetic flux from the paper passage area end corresponding to first core 55 to the paper non-passage area end corresponding to second core 56 occurs, and the efficacy of magnetic flux suppression in a paper non-passage area of fixing roller 57 becomes low. As a result, a problem with this fixing apparatus is that when small-sized recording material 59 is fed through continuously, heat is accumulated in a paper non-passage area of fixing roller 57, and an excessive rise in temperature cannot be effectively suppressed.

Also, with this fixing apparatus, only a second core 56 for one recording material size can be held in core-holding rotating member 53, and therefore the paper passage area width of fixing roller 57 can only be made to provide for two recording material paper widths—maximum size and small size.

It is an object of the present invention to provide a small fixing apparatus that can prevent an excessive rise in temperature of a paper non-passage area due to diverted flow of magnetic flux from a paper passage area of a heat-producing element to a paper non-passage area thereof.

MEANS FOR SOLVING THE PROBLEMS

A fixing apparatus of the present invention has: a magnetic flux generation section that generates magnetic flux; a heat-producing element that is induction-heated by the magnetic flux; a magnetic path forming element that is positioned opposite the heat-producing element and forms a magnetic flux path between the magnetic flux generation section and the heat-producing element; a magnetism suppressing element that is provided in the magnetic path forming element and, by coming to a masking position that masks at least part of a magnetic flux path corresponding to a paper non-passage area of the heat-producing element between the magnetic path forming element and the heat-producing element, suppresses magnetic coupling between the magnetic path forming element and the heat-producing element, the magnetic coupling being corresponding to the paper non-passage area; and a rotation section that by means of rotation causes the magnetism suppressing element to come to the masking position and a withdrawal position withdrawn from the masking position.

ADVANTAGEOUS EFFECTS OF THE INVENTION

According to the present invention, a small fixing apparatus can be provided that can prevent an excessive rise in temperature of a paper non-passage area due to diverted flow of magnetic flux from a paper passage area of a heat-producing element to a paper non-passage area.

MODES FOR CARRYING OUT THE INVENTION

Figure 1:
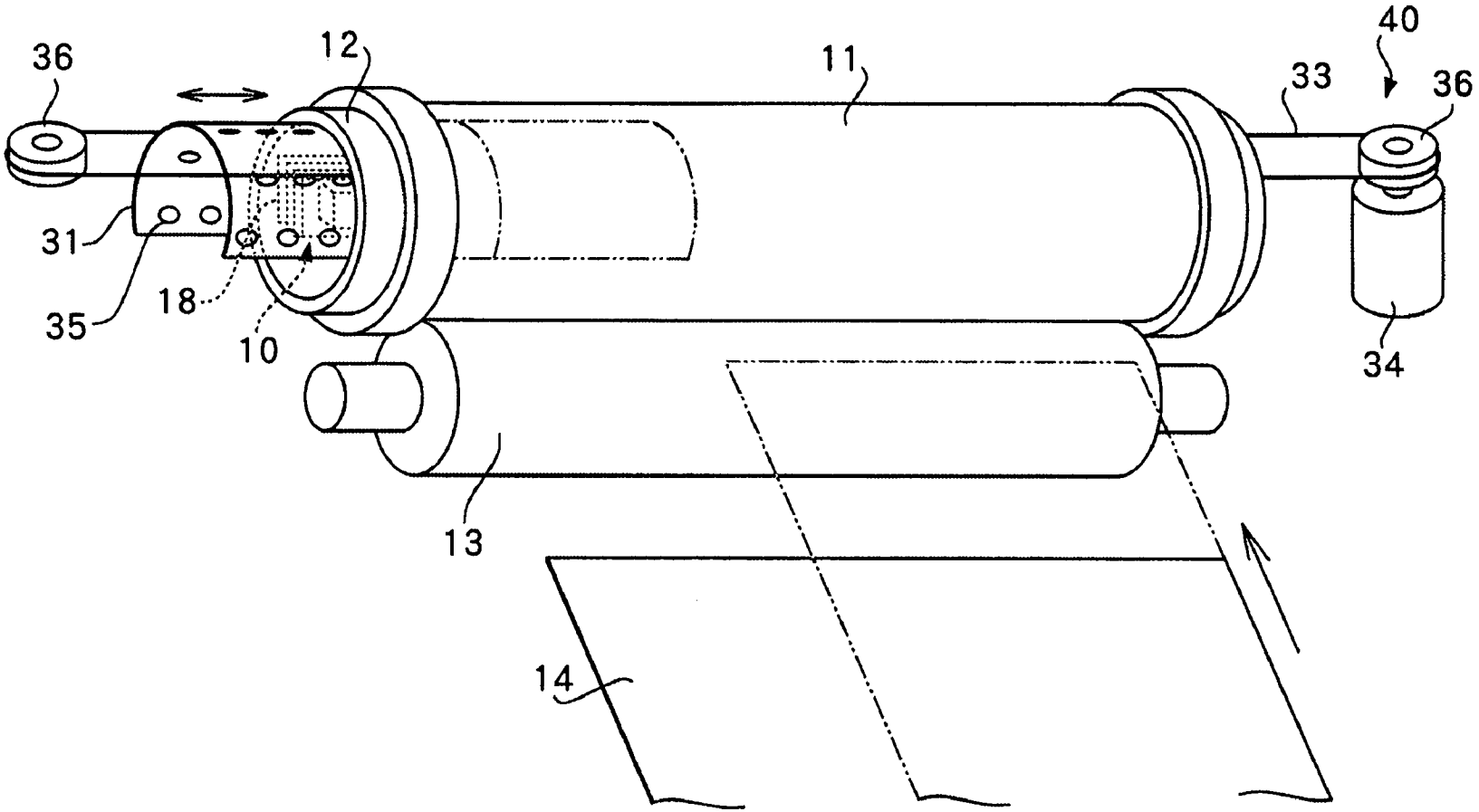
(PRIOR ART) FIG. 1
FIG. 1 is a schematic oblique drawing showing the configuration of a conventional fixing apparatus.
Figure 2A:
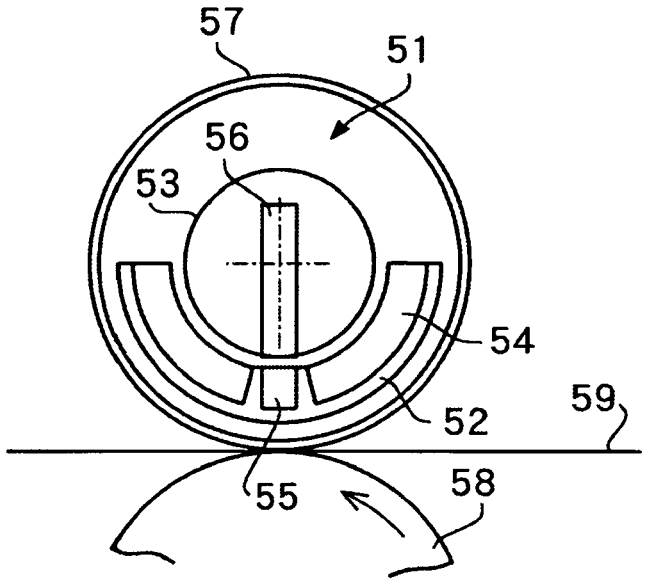
(PRIOR ART) FIG. 2A
FIG. 2A is a schematic cross-sectional view showing the configuration of the principal parts of another conventional fixing apparatus.
Figure 2B:
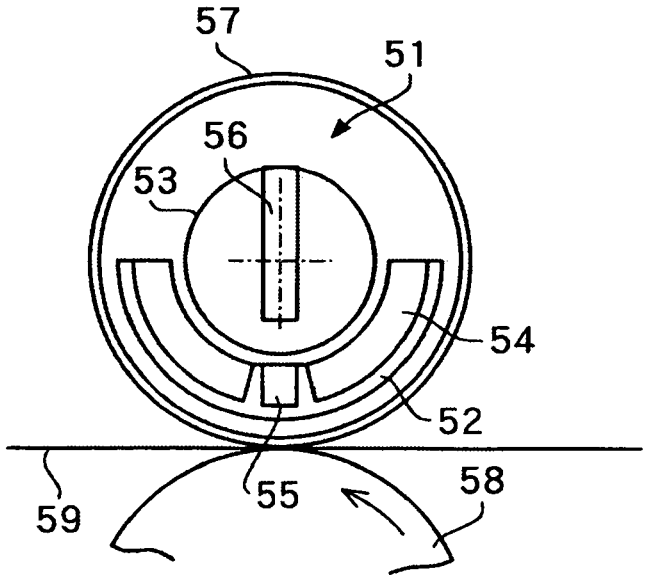
(PRIOR ART) FIG. 2B
FIG. 2B is a schematic cross-sectional view illustrating the operation of that fixing apparatus.

Embodiments of the present invention will now be described in detail with reference to the accompanying drawings. In the drawings, configuration elements and equivalent parts that have identical configurations or function are assigned the same codes, and descriptions thereof are not repeated.

Embodiment 1

Figure 3:
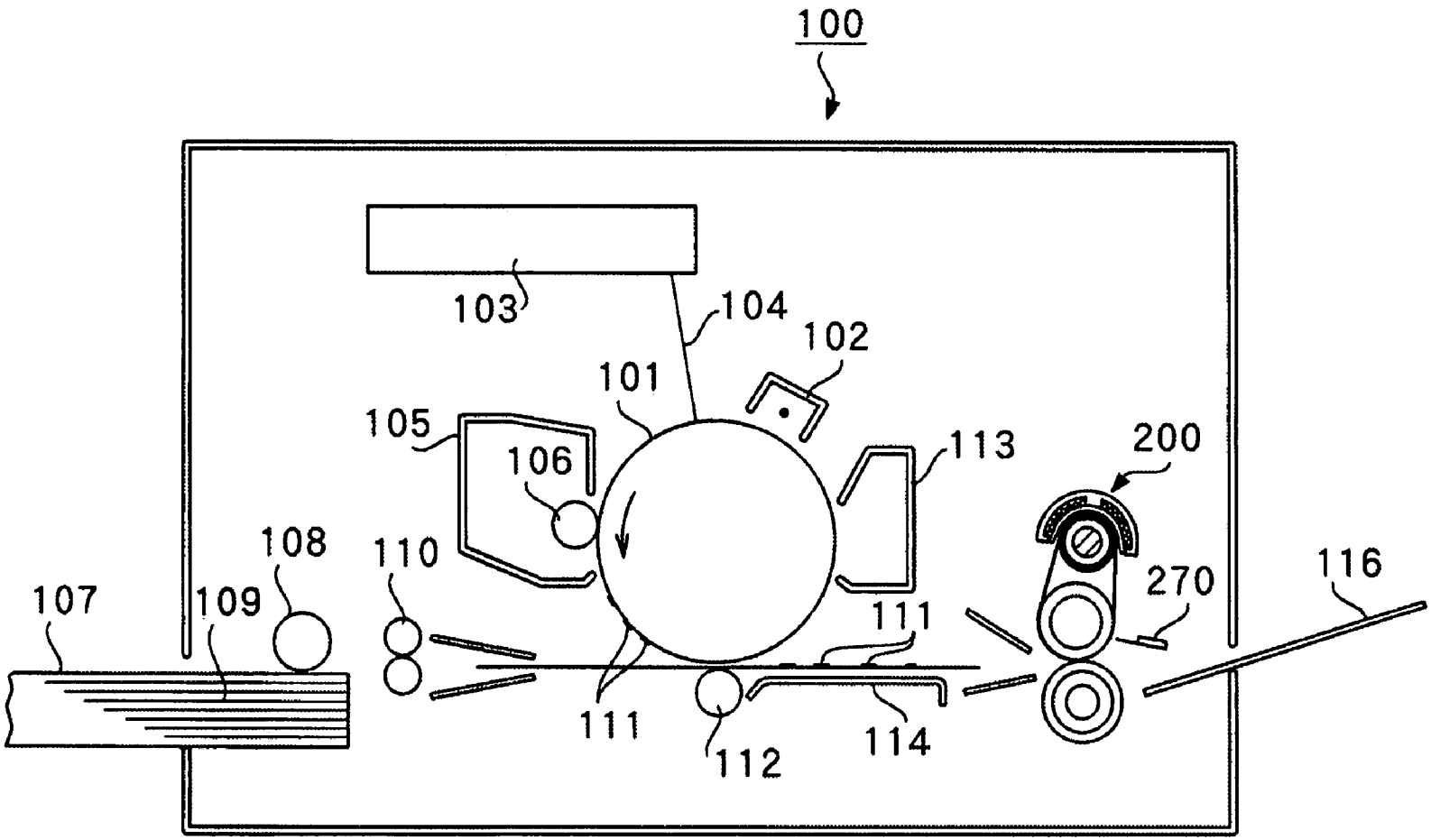
FIG. 3 is a schematic cross-sectional view showing the overall configuration of an image forming apparatus suitable for incorporation of a fixing apparatus according to Embodiment 1 of the present invention.

FIG. 3 is a schematic cross-sectional view showing the overall configuration of an image forming apparatus suitable for incorporation of a fixing apparatus according to Embodiment 1 of the present invention.

As shown in FIG. 3, an image forming apparatus 100 has an electrophotographic photosensitive body (hereinafter referred to as "photosensitive drum") 101, an electrifier 102, a laser beam scanner 103, a developing unit 105, a paper feed apparatus 107, a fixing apparatus 200, a cleaning apparatus 113, and so forth.

In FIG. 3, photosensitive drum 101 is rotated at a predetermined peripheral velocity in the direction indicated by the arrow while its surface is uniformly charged to a negative predetermined dark potential V0 by electrifier 102.

Laser beam scanner 103 outputs a laser beam 104 modulated in accordance with a time series electrical digital pixel signal of image information input from a host apparatus such as an image reading apparatus or computer (not shown), and performs scanning exposure of the surface of uniformly charged photosensitive drum 101 with laser beam 104. By this means, the absolute value of the potential of exposed parts of photosensitive drum 101 falls and becomes a light potential VL, and an electrostatic latent image is formed on the surface of photosensitive drum 101.

Developing unit 105 is provided with a rotated developing roller 106. Developing roller 106 is positioned opposite photosensitive drum 101, and a thin layer of toner is formed on its peripheral surface. A developing bias voltage with an absolute value smaller than dark potential V0 of photosensitive drum 101 and larger than light potential VL is applied to developing roller 106.

By this means, negatively charged toner on developing roller 106 adheres only to light potential VL parts of the surface of photosensitive drum 101, the electrostatic latent image formed on the surface of photosensitive drum 101 is developed, and an unfixed toner image 111 is formed on photosensitive drum 101.

Meanwhile, paper feed apparatus 107 feeds recording paper 109 as a recording medium one sheet at a time at predetermined timing by means of a paper feed roller 108. Recording paper 109 fed from paper feed apparatus 107 is transported through a pair of registration rollers 110 to the nip area between photosensitive drum 101 and a transfer roller 112 at appropriate timing synchronized with the rotation of photosensitive drum 101. By this means, unfixed toner image 111 on photosensitive drum 101 is transferred to recording paper 109 by transfer roller 112 to which a transfer bias is applied.

Recording paper 109 on which unfixed toner image 111 is formed and held in this way is guided by a recording paper guide 114 and separated from photosensitive drum 101, and then transported toward the fixing area of fixing apparatus 200. Once transported to this fixing area, recording paper 109 has unfixed toner image 111 heat-fixed onto it by fixing apparatus 200.

After passing through fixing apparatus 200, recording paper 109 onto which unfixed toner image 111 has been heat-fixed is ejected onto an output tray 116 attached to the outside of image forming apparatus 100.

After recording paper 109 has been separated from it, photosensitive drum 101 has residual material such as untransferred toner remaining on its surface removed by a cleaning apparatus 113, and is made ready for the next image forming operation.

Figure 4:
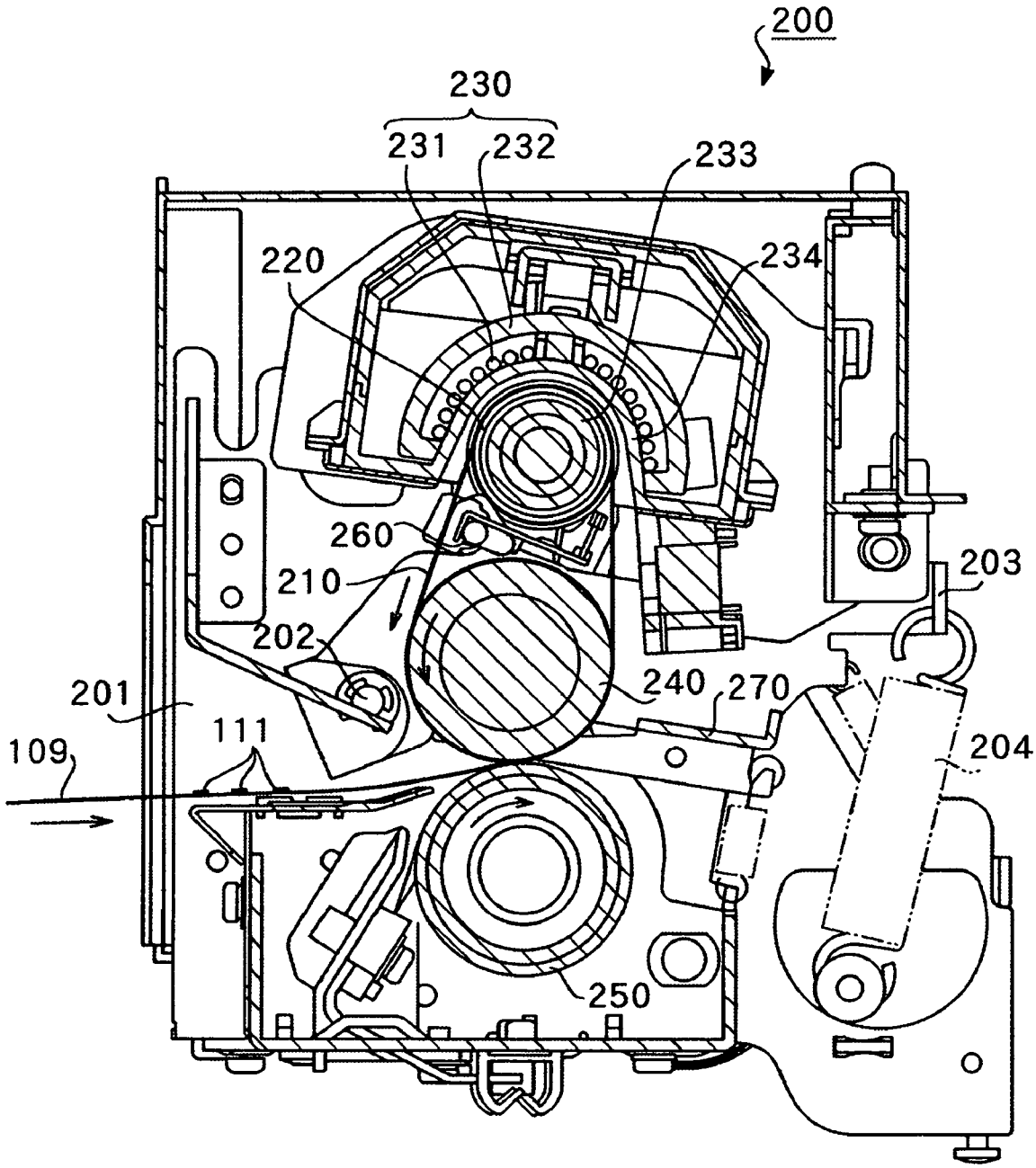
FIG. 4 is a cross-sectional view showing the basic configuration of a fixing apparatus according to Embodiment 1 of the present invention.

The fixing apparatus of image forming apparatus 100 shown in FIG. 3 will now be described. FIG. 4 is a cross-sectional view showing the configuration of this fixing apparatus. As shown in FIG. 4, fixing apparatus 200 includes a fixing belt 210, a supporting roller 220 serving as a belt supporting member, an excitation apparatus 230 serving as an induction heating section, a fixing roller 240, a pressure roller 250 serving as a belt rotation section, and so forth.

In FIG. 4, fixing belt 210 is suspended between supporting roller 220 and fixing roller 240. Supporting roller 220 is rotatably pivoted in the upper part of body side plate 201 of fixing apparatus 200. Fixing roller 240 is rotatably pivoted in a rocking plate 203 attached in a freely rocking fashion to body side plate 201 by means of a short shaft 202. Pressure roller 250 is rotatably pivoted in the lower part of body side plate 201 of fixing apparatus 200.

Rocking plate 203 rocks in a clockwise direction about short shaft 202 through the contracting action of a coil spring 204. Fixing roller 240 is displaced in line with this rocking of rocking plate 203, and through this displacement presses against pressure roller 250 with fixing belt 210 between. Supporting roller 220 is energized in the opposite direction to fixing roller 240 by a spring (not shown), by which means predetermined tension is imparted to fixing belt 210.

Pressure roller 250 is rotated in the direction indicated by the arrow by a driving source (not shown). Fixing roller 240 is rotated driven by the rotation of pressure roller 250 while gripping fixing belt 210. By this means, fixing belt 210 is rotated in the direction indicated by the arrow, gripped between fixing roller 240 and pressure roller 250. By means of this gripping and rotation of fixing belt 210, a nip area for heat-fixing unfixed toner image 111 onto recording paper 109 is formed between fixing belt 210 and pressure roller 250.

Excitation apparatus 230 comprises an IH type induction heating section, and as shown in FIG. 4, has an exciting coil 231 as a magnetism generation section installed along the outer peripheral surface of the part of fixing belt 210 suspended on supporting roller 220, and a core 232 composed of ferrite covering exciting coil 231. Exciting coil 231 extends in the paper passage width direction and is wound so as to loop back at both edges of fixing belt 210. Inside supporting roller 220 is provided an opposed core 233 that is opposite exciting coil 231 with fixing belt 210 and supporting roller 220 between.

Exciting coil 231 is formed using litz wire comprising bundled thin wires, and the cross-sectional shape is formed as a semicircle so as to cover the outer peripheral surface of fixing belt 210 suspended on supporting roller 220. An excitation current with a drive frequency of 25 kHz is applied to exciting coil 231 from an exciting circuit (not shown). By this means, an alternating field is generated between core 232 and opposed core 233, an eddy current is generated in the conductive layer of fixing belt 210, and fixing belt 210 produces heat. In this example, the configuration is such that fixing belt 210 produces heat, but a configuration may also be used whereby supporting roller 220 is made to produce heat, and heat from supporting roller 220 is transferred to fixing belt 210.

Core 232 is attached to the center and part of the rear of exciting coil 231. As an alternative to ferrite, a high-permeability material such as permalloy can also be used as the material of core 232 and opposed core 233.

In fixing apparatus 200, as shown in FIG. 4, unfixed toner image 111 can be heat-fixed onto recording paper 109 by transporting recording paper 109 to which unfixed toner image 111 has been transferred from the direction indicated by the arrow so that the surface bearing unfixed toner image 111 is brought into contact with fixing belt 210.

A temperature sensor 260 comprising a thermistor is positioned on the part of the rear surface of fixing belt 210 that has passed the area of contact with supporting roller 220. The temperature of fixing belt 210 is detected by this temperature sensor 260. The output of temperature sensor 260 is provided to a control apparatus (not shown). Based on the output of temperature sensor 260, this control apparatus controls the power supplied to exciting coil 231 via the exciting circuit so that an optimal image fixing temperature is attained, and by this means the calorific value of fixing belt 210 is controlled.

Downstream in the recording paper 109 transportation direction, an ejection guide 270 that guides recording paper 109 toward output tray 116 after heat-fixing is finished is provided in the area where fixing belt 210 is suspended on fixing roller 240.

A coil guide 234 serving as a supporting member is also provided in excitation apparatus 230, integral with exciting coil 231 and core 232. This coil guide 234 is formed of a resin with a high heat-resistance temperature such as a PEEK material or PPS. The provision of coil guide 234 makes it possible to confine heat emitted from fixing belt 210 in the space between fixing belt 210 and exciting coil 231, and prevent damage to exciting coil 231.

Although core 232 shown in FIG. 4 has a semicircular cross-section, core 232 need not necessarily have a shape that follows the shape of exciting coil 231, and may, for example, have an approximately π-shaped cross-section.

Fixing belt 210 comprises, for example, a thin endless belt with a diameter of 50 mm and thickness of 50 μm, with a conductive layer formed by dispersing silver powder in base material of polyimide resin with a glass transition point of 360 (° C.). The conductive layer may be composed of 2 or 3 laminated silver layers with a thickness of 10 μm. The surface of this fixing belt 210 may be coated with a 5 μm thick release layer of fluororesin (not shown) to provide releasability. It is desirable for the glass transition point of the material of fixing belt 210 to be in a range from 200 (° C.) to 500 (° C.). Resin or rubber with good releasability such as PTFE, PFA, FEP, silicone rubber, fluororubber, or the like, may be used, alone or mixed, for the release layer on the surface of fixing belt 210.

As an alternative to the above-mentioned polyimide resin, a heat-resistant resin such as fluororesin or metal such as an electroformed thin nickel sheet or thin stainless sheet can also be used as the base material of fixing belt 210. For example, fixing belt 210 may be configured by executing 10 μm thick copper plating on a 40 μm thick SUS304 (magnetic) or SUS304(nonmagnetic) surface.

When fixing belt 210 is used as an image heating element for heat-fixing of monochrome images, it is sufficient to secure releasability, but when fixing belt 210 is used as an image heating element for heat-fixing of color images, it is desirable for elasticity to be provided by forming a thick rubber layer. The heat capacity of fixing belt 210 should preferably be 60 J/K or less, and still more preferably 40 J/K or less.

Supporting roller 220 is a cylindrical metal roller 20 mm in diameter, 320 mm in length, and 0.2 mm thick. It is desirable for a magnetic metal such as iron or nickel to be used as the material of supporting roller 220.

When opposed core 233 opposite exciting coil 231 is used as shown in FIG. 4, it is desirable for a nonmagnetic stainless material with a resistivity of 50 μΩcm or higher to be used for supporting roller 220. A supporting roller 220 of the nonmagnetic stainless material SUS304 has a high resistivity of 72 μΩcm as well as being nonmagnetic, and therefore magnetic flux that passes through supporting roller 220 is not greatly masked, and with 0.2 mm thick material, for example, the heat production of supporting roller 220 is extremely small, and consequently fixing belt 210 produces heat effectively. Also, a supporting roller 220 of SUS304 has good mechanical strength, enabling the heat capacity to be further decreased by reducing the thickness to 0.04 mm.

Fixing roller 240 is 30 mm in diameter and made of silicone rubber, an elastic foam material with low surface hardness (here, JISA 30 degrees) and low thermal conductivity.

Pressure roller 250 is made of silicone rubber with a hardness of JISA 65 degrees. A heat-resistant resin or other rubber such as fluororubber or fluororesin may also be used as the material of pressure roller 250. It is also desirable for the surface of pressure roller 250 to be coated with resin or rubber such as PFA, PTFE, or FEP, alone or mixed, to increase wear resistance and releasability. Furthermore, it is desirable for pressure roller 250 to be made of a material with low thermal conductivity.

Figure 5:
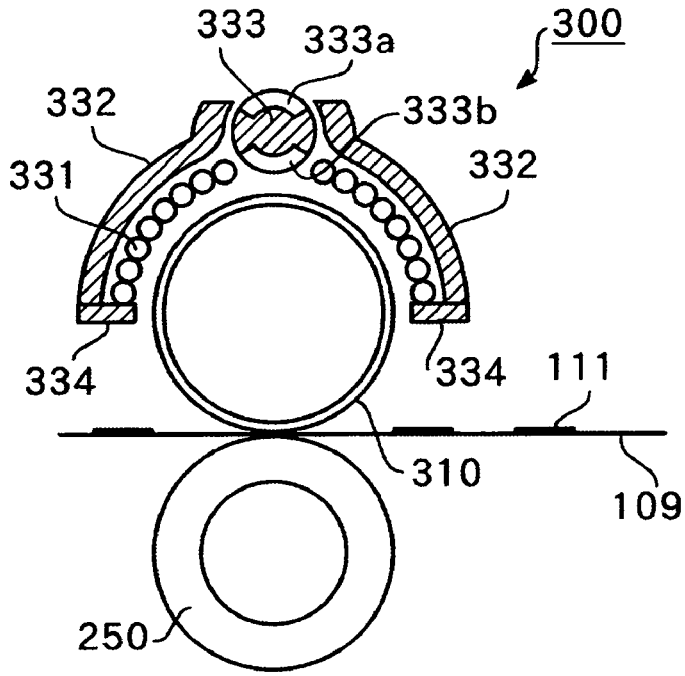
FIG. 5 is a schematic cross-sectional view showing the configuration of a fixing apparatus according to Embodiment 1 of the present invention.

The configuration of a fixing apparatus according to Embodiment 1 will now be described in greater detail. FIG. 5 is a schematic cross-sectional view showing the configuration of a fixing apparatus according to Embodiment 1. As shown in FIG. 5, a fixing apparatus 300 includes a heat-producing roller 310 of magnetic material serving as the heat-producing element, an exciting coil 331 serving as the magnetic flux generation section, arch core 332 that covers exciting coil 331, a center core 333 and side cores 334 serving as the magnetic path forming element that forms a magnetic flux path between arch core 332 and heat-producing roller 310, and so forth.

Figure 6:
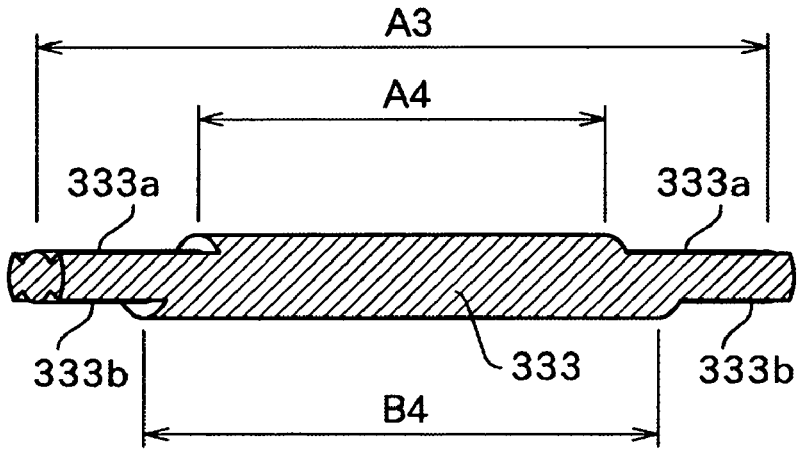
FIG. 6 is a schematic oblique drawing showing a configuration in which cutaway parts serving as magnetism suppressing elements are formed in the center core of a fixing apparatus according to Embodiment 1 of the present invention.

In FIG. 5 and FIG. 6, center core 333 comprises a columnar rotating element of a strongly magnetic material such as ferrite parallel to the rotational axis of heat-producing roller 310, located in the center of the windings of exciting coil 331. In this center core 333, two cutaway parts 333*a* and 333*b* are formed as magnetism suppressing elements in opposite sides opposite paper non-passage areas of heat-producing roller 310. These cutaway parts 333*a* and 333*b* are positioned so as to be mutually opposed with center core 333 between.

For cutaway parts 333*a* and 333*b* the center core 333 forming position is decided according to the paper passage reference of recording paper 109. Here, cutaway parts 333*a* and 333*b* are formed at both ends of center core 333 taking the paper passage reference of recording paper 109 as the center reference.

The length of center core 333 is formed so as to exceed the width of B4 size recording paper, which is the maximum paper passage area width of heat-producing roller 310. Here, as shown in FIG. 6, the length of center core 333 is formed so as to correspond to the width of A3 size recording paper. Cutaway parts 333*a* have a length corresponding to the paper non-passage area width of heat-producing roller 310 when A4 size recording paper is passed through to the nip area between heat-producing roller 310 and pressure roller 250, and cutaway parts 333*b* have a length corresponding to the paper non-passage area width of heat-producing roller 310 when B4 size recording paper is passed through to the nip area between heat-producing roller 310 and pressure roller 250.

Figure 7:
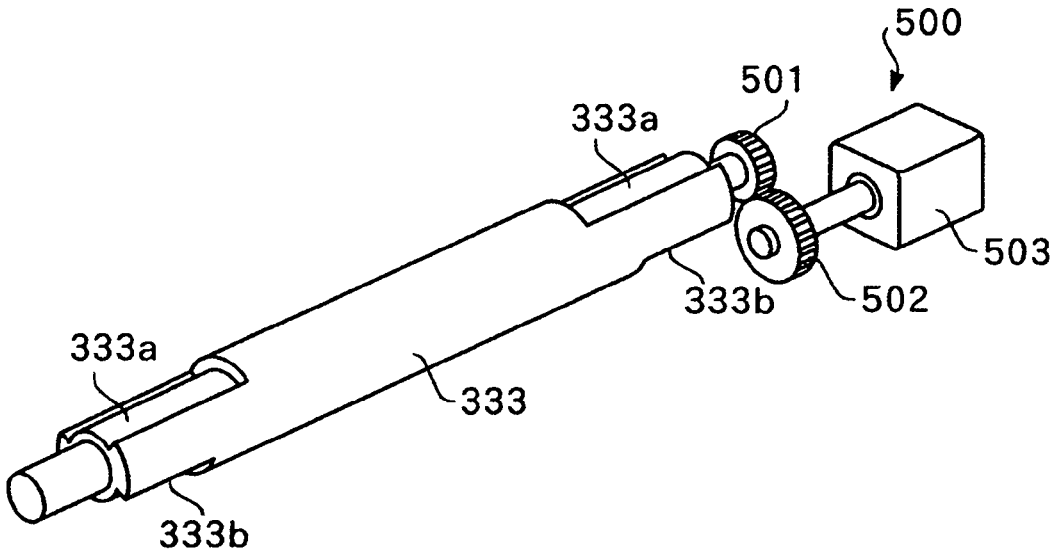
FIG. 7 is a schematic oblique drawing showing the configuration of a rotation section that rotates cutaway parts serving as magnetism suppressing elements of a fixing apparatus according to Embodiment 1 of the present invention.

FIG. 7 is a schematic oblique drawing showing the configuration of a rotation section 500 that rotates cutaway parts 333*a* and 333*b* of center core 333. As shown in FIG. 7, this rotation section 500 is composed of a small gear wheel 501 attached to the spindle of center core 333, a large gear wheel 502 that meshes with small gear wheel 501, a stepping motor 503 that is axially connected to and rotates large gear wheel 502, and so forth.

In FIG. 7, when stepping motor 503 is turned on (energized), large gear wheel 502 is rotated by the rotation of the spindle of stepping motor 503, and small gear wheel 501 rotates driven by large gear wheel 502. Through this driven rotation of small gear wheel 501, of cutaway parts 333*a* and 333*b*, predetermined cutaway parts of a length corresponding to the paper non-passage area width of the passed-through recording paper size rotate from the withdrawal position shown in FIG. 8 to the masking position shown in FIG. 5.

Here, as shown in FIG. 5, cutaway parts 333*b* rotate from their withdrawal position to their masking position. Through the rotation of cutaway parts 333*b* from their withdrawal position to their masking position in this way, magnetic coupling between center core 333 and heat-producing roller 310 corresponding to paper non-passage areas of heat-producing roller 310 when B4 size recording paper is passed through is suppressed by cutaway parts 333*b*.

Similarly, when cutaway parts 333*a* are rotated from their withdrawal position to their masking position by rotation section 500, magnetic coupling between center core 333 and heat-producing roller 310 corresponding to paper non-passage areas of heat-producing roller 310 when A4 size recording paper is passed through is suppressed by cutaway parts 333*a*.

In this way., this fixing apparatus 300 controls magnetic coupling between center core 333 and heat-producing roller 310 by rotating cutaway parts 333*a* and 333*b* from their withdrawal position to their masking position by means of rotation section 500.

Figure 8:
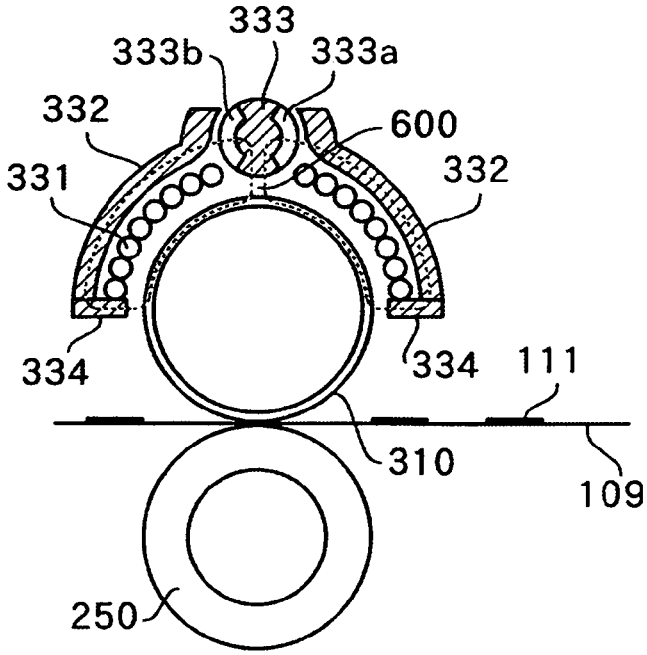
FIG. 8 is a schematic cross-sectional view showing a state in which cutaway parts serving as magnetism suppressing elements of a fixing apparatus according to Embodiment 1 of the present invention have been rotated to the withdrawal position.

That is to say, in this fixing apparatus 300, through the rotation of center core 333, the distance between heat-producing roller 310 and center core 333 in areas corresponding to the paper non-passage areas varies according to whether cutaway parts 333*a* and 333*b* constituting magnetism suppressing elements have been moved to the masking position shown in FIG. 5 or have been moved to the withdrawal position shown in FIG. 8.

The distance between heat-producing roller 310 and center core 333 in areas corresponding to paper non-passage areas is increased when cutaway parts 333*a* or 333*b* have been moved to the masking position, as shown in FIG. 5, and is decreased when cutaway parts 333*a* or 333*b* have been moved to the withdrawal position, as shown in FIG. 8.

Also, magnetic coupling between center core 333 and heat-producing roller 310 strengthens when the distance between center core 333 and heat-producing roller 310 decreases, and weakens when the distance between center core 333 and heat-producing roller 310 increases.

Therefore, with this fixing apparatus 300, an excessive rise in temperature of paper non-passage areas of heat-producing roller 310 can be suppressed by weakening the magnetic coupling between center core 333 and heat-producing roller 310 by moving cutaway parts 333*a* and 333*b* to the masking position by rotating center core 333 by means of rotation section 500.

Also, in this fixing apparatus 300, since switching of the intensity of magnetic coupling between center core 333 and heat-producing roller 310 can be performed simply by rotating center core 333, the paper passage area width of heat-producing roller 310 can easily be made to accommodate the paper widths of two sizes of recording paper—A4 size and B4 size—as shown in FIG. 6.

Furthermore, with this fixing apparatus 300, since the magnetism suppressing elements are configured as cutaway parts 333*a* and 333*b* formed in center core 333, it is not necessary for the magnetism suppressing elements to be provided as separate members, enabling the configuration to be made simpler and less expensive.

Embodiment 2

Figure 9:
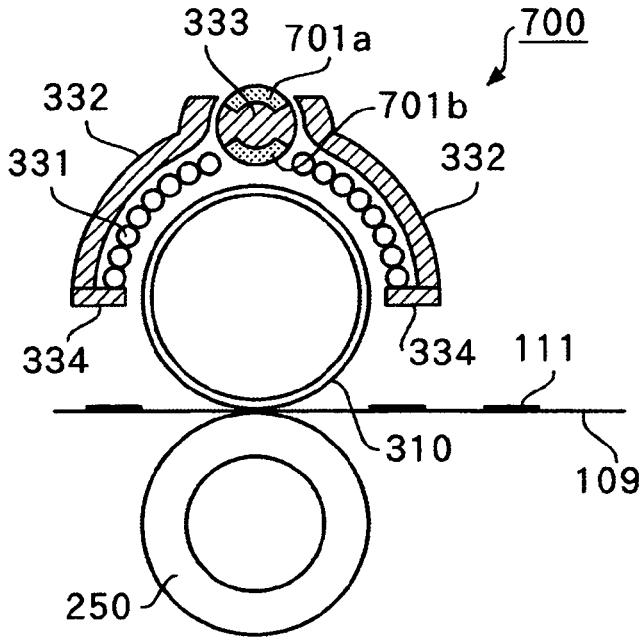
FIG. 9 is a schematic cross-sectional view showing the configuration of a fixing apparatus according to Embodiment 2 of the present invention.

Next, the configuration of distinctive parts of a fixing apparatus according to Embodiment 2 will be described. FIG. 9 is a schematic cross-sectional view showing the configuration of a fixing apparatus according to Embodiment 2. As shown in FIG. 9, in this fixing apparatus 700 the magnetism suppressing elements are configured as magnetism masking members 701*a* and 701*b*, while the rest of the configuration is similar to that of fixing apparatus 300 according to Embodiment 1.

Figure 10:
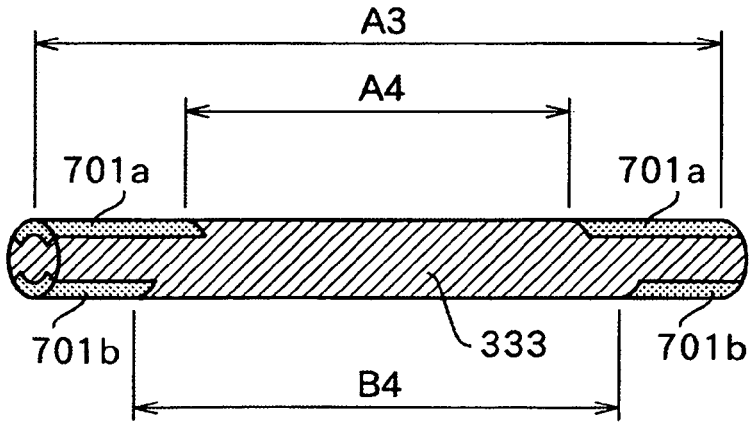
FIG. 10 is a schematic oblique drawing showing a configuration in which magnetism masking members serving as magnetism suppressing elements are provided in the center core of a fixing apparatus according to Embodiment 2 of the present invention.

Magnetism masking members 701*a* and 701*b* serving as magnetism suppressing elements are formed of a material that can mask magnetic coupling between center core 333 and heat-producing roller 310 corresponding to paper non-passage areas of heat-producing roller 310—for example, an inexpensive, low-permeability electrical conductor such as copper or aluminum. As shown in FIG. 9 and FIG. 10, these magnetism masking members 701*a* and 701*b* are provided opposite each other in the peripheral surface of center core 333 opposite paper non-passage areas of heat-producing roller 310.

As with fixing apparatus 300 according to Embodiment 1, fixing apparatus 700 according to Embodiment 2 has the paper passage reference of recording paper 109 as a center reference, and magnetism masking members 701*a* and 701*b* are formed at both ends of center core 333.

Here, center core 333 is formed so as to exceed the width of B4 size recording paper, which is the maximum paper passage area width of heat-producing roller 310. Here, as shown in FIG. 10, the length of center core 333 is formed so as to correspond to the width of A3 size recording paper. Magnetism masking members 701*a* have a length corresponding to the paper non-passage area width of heat-producing roller 310 when A4 size recording paper is passed through to the nip area between heat-producing roller 310 and pressure roller 250, and magnetism masking members 701*b* have a length corresponding to the paper non-passage area width of heat-producing roller 310 when B4 size recording paper is passed through to the nip area between heat-producing roller 310 and pressure roller 250.

Figure 11:
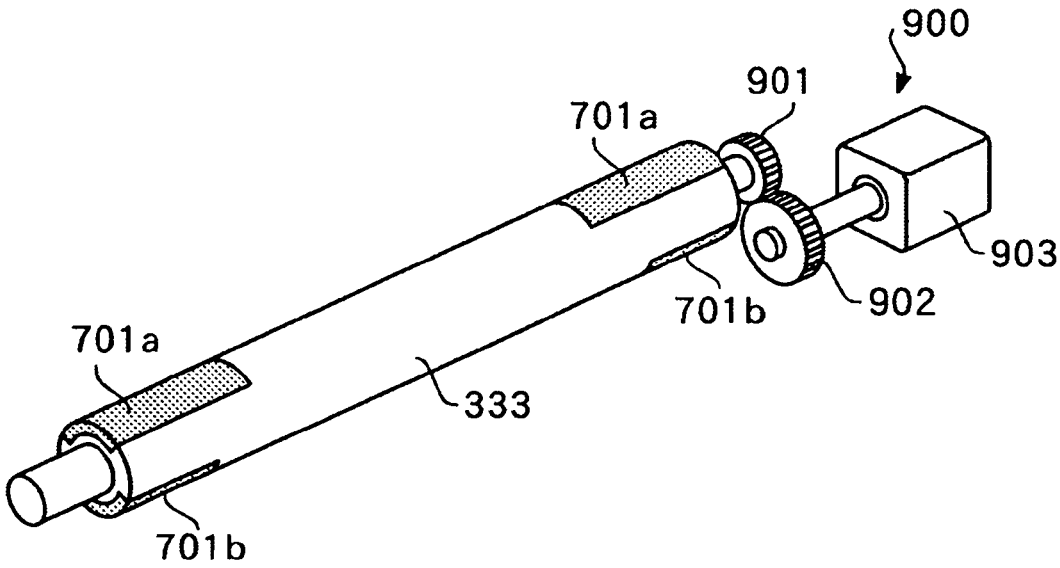
FIG. 11 is a schematic oblique drawing showing the configuration of a rotation section that rotates magnetism masking members serving as magnetism suppressing elements of a fixing apparatus according to Embodiment 2 of the present invention.

Magnetism masking members 701*a* and 701*b* are rotated together with center core 333 by means of a rotation section 900 shown in FIG. 11. Similarly to rotation section 500 shown in FIG. 7, this rotation section 900 is composed of a small gear wheel 901 attached to the spindle of center core 333, a large gear wheel 902 that meshes with small gear wheel 901, a stepping motor 903 that is axially connected to and rotates large gear wheel 902, and so forth.

Figure 12:
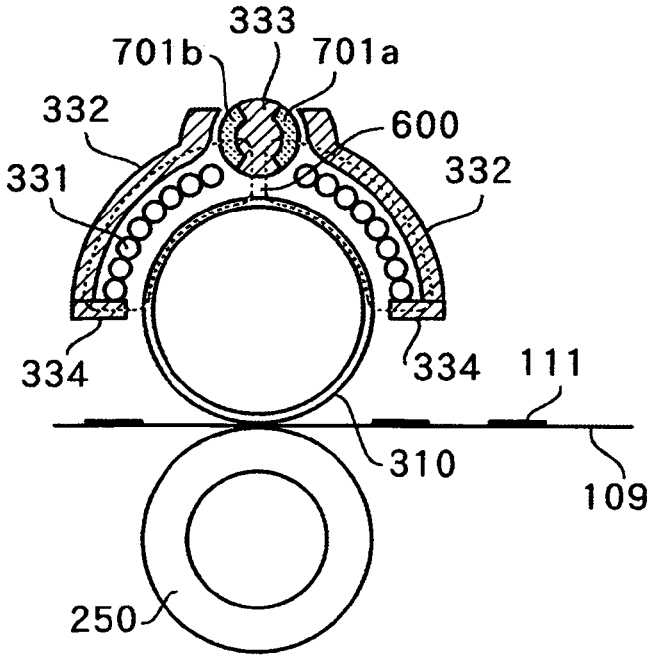
FIG. 12 is a schematic cross-sectional view showing a state in which magnetism masking members serving as magnetism suppressing elements of a fixing apparatus according to Embodiment 2 of the present invention have been rotated to the withdrawal position.

In FIG. 11, when stepping motor 903 is turned on (energized), large gear wheel 902 is rotated by the rotation of the spindle of stepping motor 903, and small gear wheel 901 rotates driven by large gear wheel 902. Through this driven rotation of small gear wheel 901, of magnetism masking members 701*a* and 701*b*, predetermined magnetism masking members of a length corresponding to the paper non-passage area width of the passed-through recording paper size rotate from the withdrawal position shown in FIG. 12 to the masking position shown in FIG. 9.

Here, as shown in FIG. 9, magnetism masking members 701*b* rotate from their withdrawal position to their masking position. Through the rotation of magnetism masking members 701*b* from their withdrawal position to their masking position in this way, magnetic coupling between center core 333 and heat-producing roller 310 corresponding to paper non-passage areas of heat-producing roller 310 when B4 size recording paper is passed through is suppressed by magnetism masking members 701*b*.

Similarly, when magnetism masking members 701*a* are rotated from their withdrawal position to their masking position by rotation section 900, magnetic coupling between center core 333 and heat-producing roller 310 corresponding to paper non-passage areas of heat-producing roller 310 when A4 size recording paper is passed through is suppressed by magnetism masking members 701*a*.

In this way, this fixing apparatus 700 blocks or boosts magnetic coupling between center core 333 and heat-producing roller 310 by rotating magnetism masking members 701*a* and 701*b* from their withdrawal position to their masking position by means of rotation section 900.

That is to say, in this fixing apparatus 700, when magnetism masking members 701*a* and 701*b* have been moved to the masking position shown in FIG. 9 through the rotation of center core 333, magnetic coupling between heat-producing roller 310 and center core 333 in areas corresponding to the paper non-passage areas is blocked.

Thus, with this fixing apparatus 700, an excessive rise in temperature of paper non-passage areas of heat-producing roller 310 can be suppressed by having the magnetic coupling between center core 333 and heat-producing roller 310 blocked by moving magnetism masking members 701*a* and 701*b* to the masking position by rotating center core 333 by means of rotation section 900.

Also, in this fixing apparatus 700, as with fixing apparatus 300 according to Embodiment 1, since the magnetic coupling between center core 333 and heat-producing roller 310 can be blocked or boosted simply by rotating center core 333, the paper passage area width of heat-producing roller 310 can easily be made to accommodate the paper widths of two sizes of recording paper—A4 size and B4 size—as shown in FIG. 10.

Furthermore, with this fixing apparatus 700, since the magnetism suppressing elements are configured as magnetism masking members 701*a* and 701*b* provided in center core 333, it is not necessary for the magnetism suppressing elements to be provided as separate members, enabling the configuration to be made simpler and less expensive.

Also, since this fixing apparatus 700 has a configuration whereby magnetism masking members 701*a* and 701*b* are positioned in the center of the windings of exciting coil 331, the necessity of making magnetism masking members 701*a* and 701*b* thin can be eliminated, and it is possible for their thickness to be increased to around 1 mm for example. As a result, the electrical resistance of magnetism masking members 701*a* and 701*b* becomes low, and heat production of magnetism masking members 701*a* and 701*b* is suppressed. Moreover, since magnetism masking elements 301 are provided in center core 333 composed of a material with high thermal conductivity and specific heat such as ferrite, heat generated by magnetism masking members 701*a* and 701*b* is conducted and dispersed in center core 333, and an excessive rise in temperature of magnetism masking members 701*a* and 701*b* is suppressed. Furthermore, increasing the thickness of magnetism masking members 701*a* and 701*b* reduces their electrical resistance, making it easier for an eddy current to flow. As a result, a repulsive field is strengthened, and magnetic flux can be more effectively masked. Also, since magnetism masking members 701*a* and 701*b* do not require through-holes 35, they can mask magnetic flux more effectively than magnetic flux masking shield 31 in FIG. 1.

Embodiment 3

Figure 13:
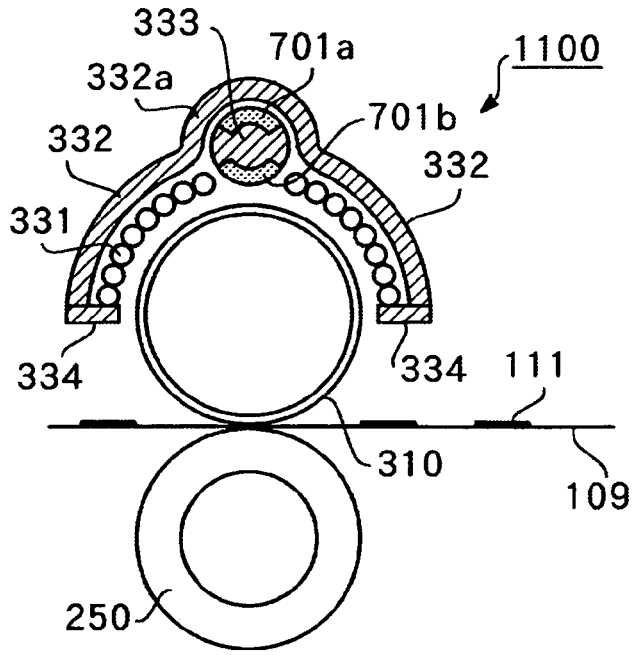
FIG. 13 is a schematic cross-sectional view showing the configuration of a fixing apparatus according to Embodiment 3 of the present invention.

Next, the configuration of a fixing apparatus according to Embodiment 3 will be described. FIG. 13 is a schematic cross-sectional view showing the configuration of a fixing apparatus according to Embodiment 3. As shown in FIG. 13, in this fixing apparatus 1100 a bypass path section 332*a* forming a magnetic flux path is formed so as to circumvent center core 333 on the side opposite heat-producing roller 310 in arch core 332 covering exciting coil 331 with center core 333 between. The rest of the configuration of this fixing apparatus 1100 is similar to that of fixing apparatus 700 according to Embodiment 2.

In this fixing apparatus 1100, in addition to a magnetic flux path whose degree of magnetic coupling is regulated by magnetism masking members 701*a* and 701*b* serving as magnetism suppressing elements formed in center core 333, a new magnetic flux path is formed by bypass path section 332*a* of arch core 332.

Thus, in this fixing apparatus 1100 a new path can be secured by means of bypass path section 332*a*, making it possible to increase the number of paper passage area sizes for which paper passage is possible without causing an excessive rise in temperature of heat-producing roller 310.

That is to say, with this fixing apparatus 1100, within a closed-loop of magnetic path 600, an area in which magnetic flux between center core 333 and heat-producing roller 310 is concentrated is masked by magnetism masking members 701*a* and 701*b*. Therefore, in this fixing apparatus 1100, magnetic coupling between center core 333 and heat-producing roller 310 corresponding to paper non-passage areas of heat-producing roller 310 can be efficiently suppressed, the rotational-direction width of magnetism masking members 701*a* and 701*b*, which are above-described magnetism suppressing elements, can be made small, and, as shown in FIG. 13, two magnetism masking members 701*a* and 701*b* can be formed in center core 333.

Figure 14:
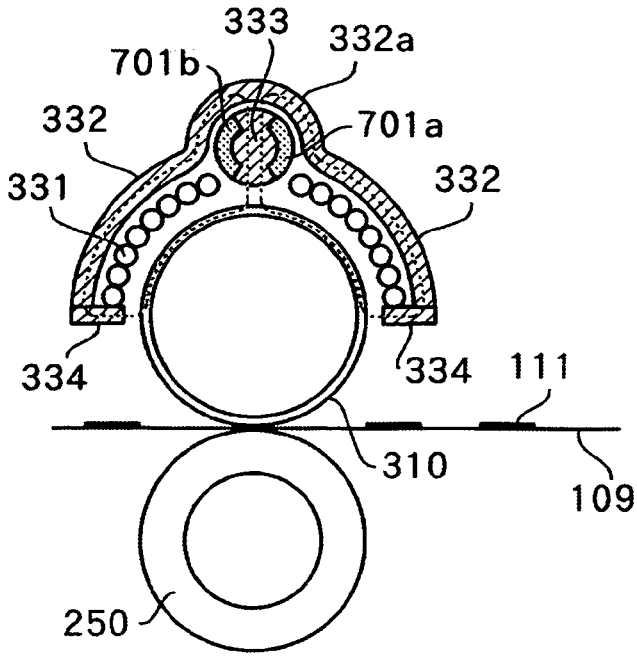
FIG. 14 is a schematic cross-sectional view showing a state in which cutaway parts serving as magnetism suppressing elements of a fixing apparatus according to Embodiment 3 of the present invention have been rotated to the withdrawal position.

Therefore, in this fixing apparatus 1100, it is possible to make the paper passage area of heat-producing roller 310 accommodate recording paper of two sizes regulated by the two magnetism masking members 701*a* and 701*b* formed in center core 333 and, as shown in FIG. 14, recording paper of a third size corresponding to the new magnetic flux path passing through bypass path section 332*a* of arch core 332. With this embodiment, A3 size can be accommodated in addition to the A4 and B4 sizes in FIG. 10.

Also, since this fixing apparatus 1100 has a configuration whereby magnetism masking members 701*a* and 701*b* are positioned in the center of the windings of exciting coil 331, the necessity of making magnetism masking members 701*a* and 701*b* thin can be eliminated, and it is possible for their thickness to be increased to around 1 mm for example. As a result, the electrical resistance of magnetism masking members 701*a* and 701*b* becomes low, and heat production of magnetism masking members 701*a* and 701*b* is suppressed. Moreover, since magnetism masking elements 301 are provided in center core 333 composed of a material with high thermal conductivity and specific heat such as ferrite, heat generated by magnetism masking members 701*a* and 701*b* is conducted and dispersed in center core 333, and an excessive rise in temperature of magnetism masking members 701*a* and 701*b* is suppressed. Furthermore, increasing the thickness of magnetism masking members 701*a* and 701*b* reduces their electrical resistance, making it easier for an eddy current to flow. As a result, a repulsive field is strengthened, and magnetic flux can be more effectively masked. Also, since magnetism masking members 701*a* and 701*b* do not require through-holes 35, they can mask magnetic flux more effectively than magnetic flux masking shield 31 in FIG. 1.

Embodiment 4

Figure 15:
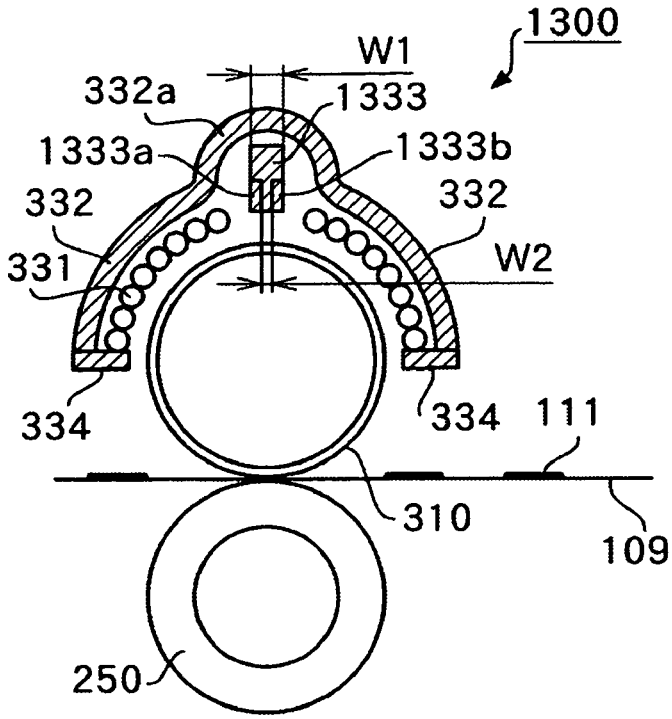
FIG. 15 is a schematic cross-sectional view showing the configuration of a fixing apparatus according to Embodiment 4 of the present invention.
Figure 16:
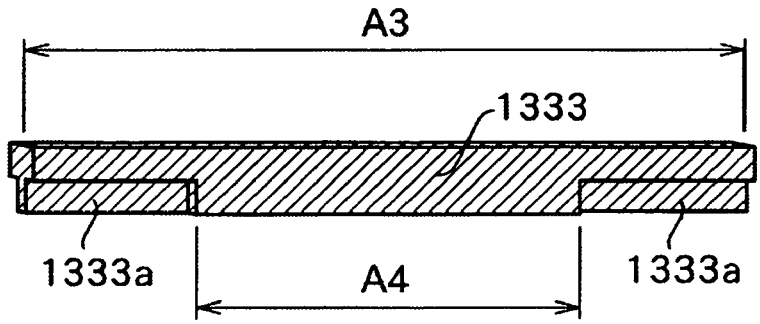
FIG. 16 is a schematic oblique drawing showing the configuration of the center core of a fixing apparatus according to Embodiment 4 of the present invention.

Next, the configuration of a fixing apparatus according to Embodiment 4 will be described. FIG. 15 is a schematic cross-sectional view showing the configuration of a fixing apparatus according to Embodiment 4. As shown in FIG. 15 and FIG. 16, in this fixing apparatus 1300 the magnetism suppressing elements are configured as stepped parts 1333*a* and 1333*b*, while the rest of the configuration is similar to that of fixing apparatus 300 according to Embodiment 1.

The center core 1333 of this fixing apparatus 1300 is configured as a rectangular shaft. As shown in FIG. 16, stepped parts 1333*a* and 1333*b* serving as magnetism suppressing elements are formed in the lower half of both ends of center core 1333 facing paper non-passage areas of heat-producing roller 310. As a result, as shown in FIG. 15, rotational-direction width W1 of an opposite surface of center core 1333 on the side in which stepped parts 1333*a* and 1333*b* are not formed is greater than rotational-direction width W2 of an opposite surface of center core 1333 on the side in which stepped parts 1333*a* and 1333*b* are formed.

That is to say, in this fixing apparatus 1300, through the rotation of center core 1333, the rotational-direction width of an opposite surface of center core 1333 facing paper non-passage areas of heat-producing roller 310 varies according to whether stepped parts 1333*a* and 1333*b* constituting magnetism suppressing elements have been moved to an opposing position opposite heat-producing roller 310 or have been moved to a withdrawal position in which they are withdrawn from heat-producing roller 310.

The rotational-direction width of an opposite surface of center core 1333 facing paper non-passage areas of heat-producing roller 310 is large width W1 when stepped parts 1333*a* and 1333*b* have been moved to the withdrawal position, and is narrow width W2 when stepped parts 1333*a* and 1333*b* have been moved to the opposing position. Also, magnetic coupling between heat-producing roller 310 and center core 1333 strengthens when the rotational-direction width of an opposite surface of center core 1333 facing paper non-passage areas of heat-producing roller 310 becomes greater, and weakens when the rotational-direction width of an opposite surface of center core 1333 facing paper non-passage areas of heat-producing roller 310 becomes narrower.

Therefore, according to this fixing apparatus 1300, an excessive rise in temperature of paper non-passage areas of heat-producing roller 310 can be suppressed by weakening the magnetic coupling between heat-producing roller 310 and center core 1333 and by moving stepped parts 1333*a* and 1333*b* to the opposing position by rotating center core 1333 by means of rotation section 500 (or 900).

Also, in this fixing apparatus 1300, since switching of the intensity of magnetic coupling between heat-producing roller 310 and center core 1333 can be performed simply by rotating center core 1333, the paper passage area width of heat-producing roller 310 can easily be made to accommodate paper widths of a plurality of sizes of recording paper.

Furthermore, with this fixing apparatus 1300, it is not necessary for the magnetism suppressing elements to be provided as separate members, enabling the configuration to be made simpler and less expensive. Thus, according to this fixing apparatus 1300, an excessive rise in temperature of paper non-passage areas of heat-producing roller 310 can easily be prevented when a plurality of sizes of recording paper are passed through.

Figure 17A:
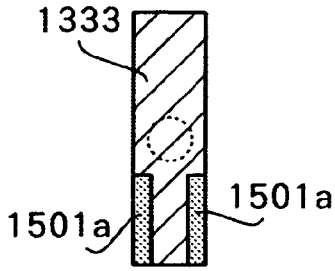
FIG. 17A is a schematic cross-sectional view showing the configuration of a rectangular center core of a fixing apparatus according to Embodiment 4 of the present invention.
Figure 17B:
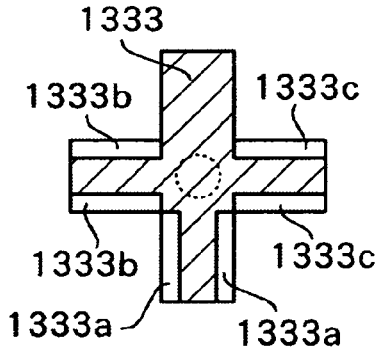
FIG. 17B is a schematic cross-sectional view showing the configuration of a cross-shaped center core of a fixing apparatus according to Embodiment 4 of the present invention.
Figure 17C:
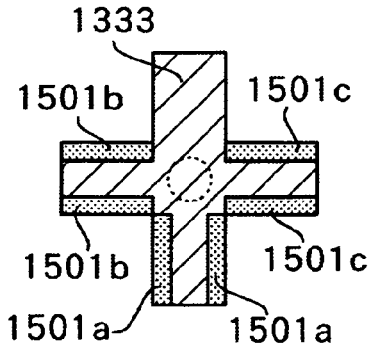
FIG. 17C is a schematic cross-sectional view showing a configuration in which magnetism masking members are embedded in stepped parts of a cross-shaped center core of a fixing apparatus according to Embodiment 4 of the present invention.

Instead of the rectangular shape of center core 1333 in this fixing apparatus 1300 shown in FIG. 16, a cross shape may be used in which four kinds of stepped parts 1333*a*, 1333*b*, and 1333*c* are formed as shown in FIG. 17B.

Also, a configuration may be used whereby magnetism masking members 1501*a*, 1501*b*, and 1501*c* of copper or aluminum are embedded in stepped parts of center core 1333.

Embodiment 5

Figure 18:
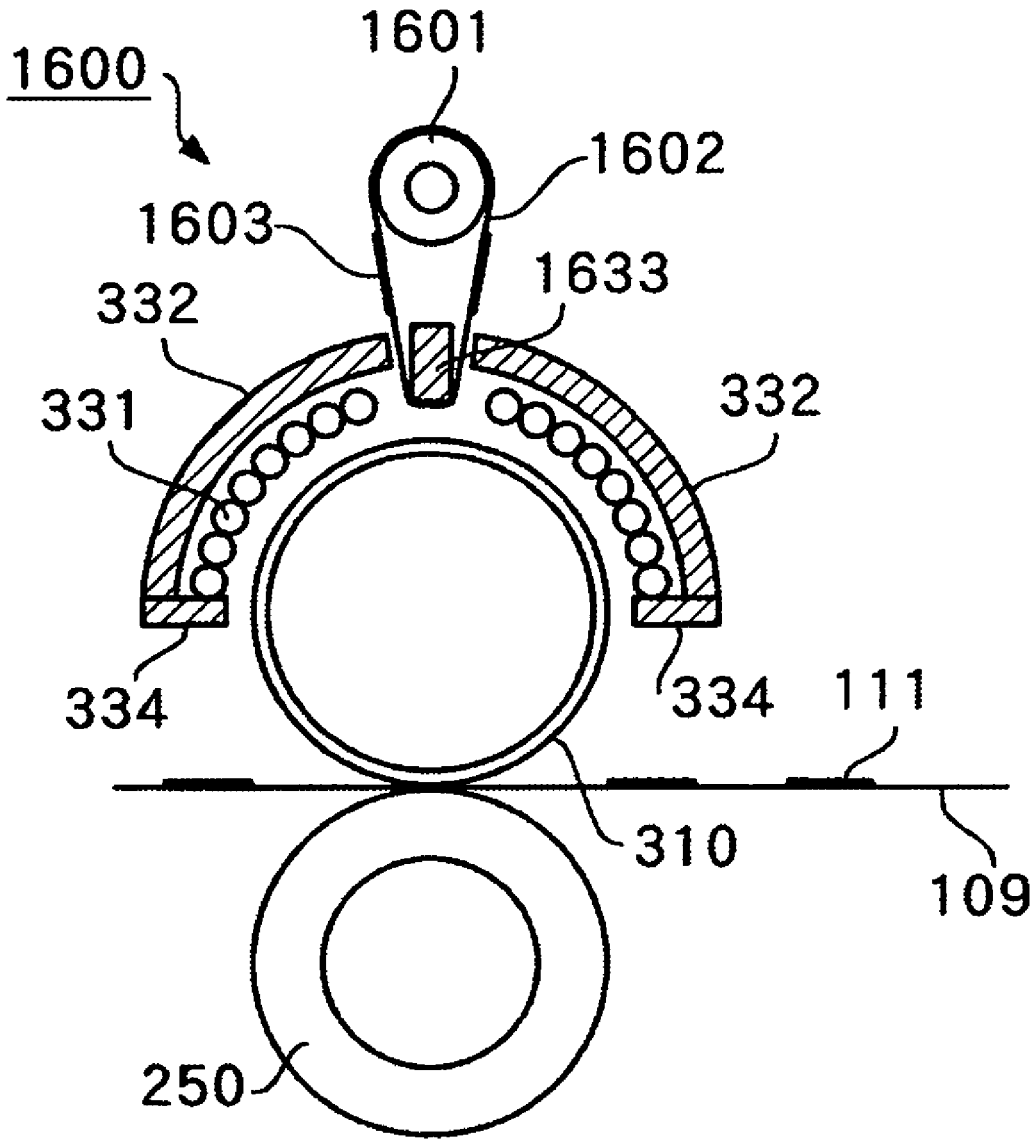
FIG. 18 is a schematic cross-sectional view showing the configuration of a fixing apparatus according to Embodiment 5 of the present invention.

Next, the configuration of a fixing apparatus according to Embodiment 5 will be described. FIG. 18 is a schematic cross-sectional view of a fixing apparatus according to Embodiment 5. As shown in FIG. 18, in this fixing apparatus 1600, an endless belt 1602 rotated by means of a pulley 1601 is suspended on a center core 1633 serving as a magnetic path forming element, and a magnetism masking layer 1603 of predetermined width serving as a magnetism suppressing element is formed on the peripheral surface of this endless belt 1602.

Figure 19:
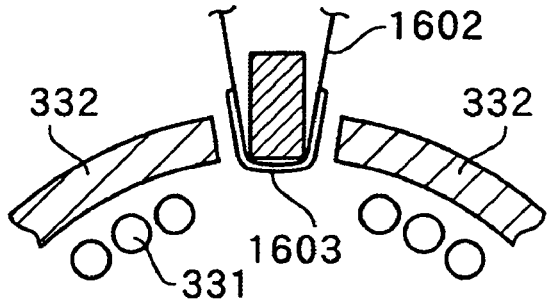
FIG. 19 is a schematic cross-sectional view illustrating the operation of the principal parts of a fixing apparatus according to Embodiment 5 of the present invention.

In this fixing apparatus 1600, endless belt 1602 is rotated by means of pulley 1601, and a part of center core 1633 corresponding to a paper non-passage area of heat-producing roller 310 is concealed by magnetism masking layer 1603 on the peripheral surface of this endless belt 1602 as shown in FIG. 19.

By this means, the degree of magnetic coupling between center core 1633 and heat-producing roller 310 corresponding to a paper non-passage area concealed by magnetism masking layer 1603 of endless belt 1602, and an excessive rise in temperature of a paper non-passage area of heat-producing roller 310 is suppressed.

Also, in this fixing apparatus 1600, many magnetism masking layers 1603 serving as magnetism suppressing elements can be provided by making endless belt 1602 longer, enabling the heat-producing element to be configured so as to accommodate more paper-passage sizes (heating widths).

Embodiment 6

Figure 20:
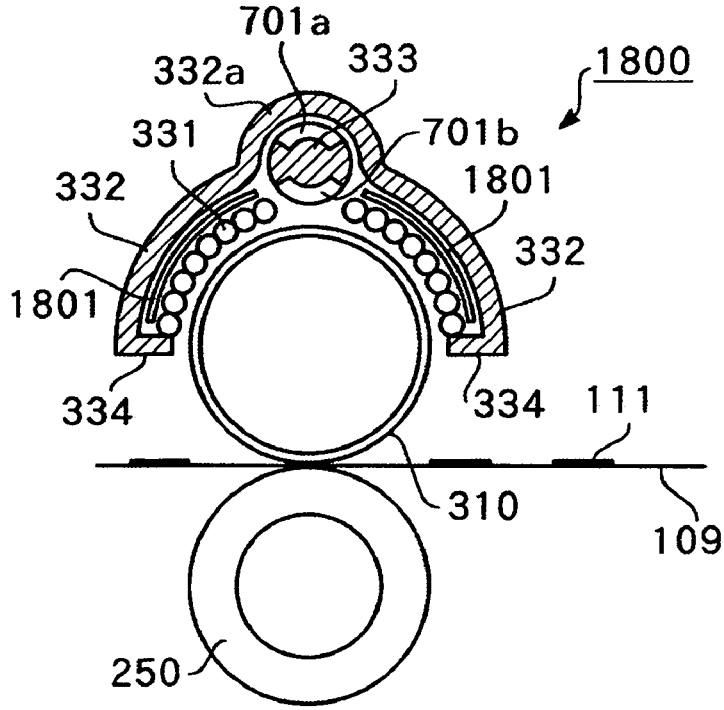
FIG. 20 is a schematic cross-sectional view showing the configuration of a fixing apparatus according to Embodiment 6 of the present invention.

Next, the configuration of a fixing apparatus according to Embodiment 6 will be described. FIG. 20 is a schematic cross-sectional view showing the configuration of a fixing apparatus according to Embodiment 6. As shown in FIG. 20, this fixing apparatus 1800 is configured with the provision of a leakage magnetism masking element 1801 between arch core 332 and exciting coil 331, while the rest of the configuration is similar to that of fixing apparatus 1100 according to Embodiment 3.

As magnetism masking members 701*b* serving as magnetism suppressing elements block magnetic coupling between center core 333 and heat-producing roller 310, an excessive rise in temperature of paper non-passage areas of heat-producing roller 310 is suppressed. However, a little leakage flux is generated that reaches heat-producing roller 310 from arch core 332 via exciting coil 331. As this leakage flux is blocked by leakage magnetism masking element 1801, an excessive rise in temperature of paper non-passage areas is effectively suppressed.

It is desirable for leakage magnetism masking element 1801 to be narrower than the width of the winding section of exciting coil 331. In this way, when the maximum paper passage area width of heat-producing roller 310 is heated, leakage magnetism masking element 1801 does not affect the closed loop of magnetic path 600 shown in FIG. 14, and temperature unevenness does not occur.

In the fixing apparatuses according to the above-described embodiments, heat-producing roller 310 has been used as the heat-producing element, but this heat-producing element may also be fixing belt 210 shown in FIG. 4.

In the fixing apparatuses according to the above-described embodiments, the magnetic path forming element in which magnetism suppressing elements are provided is assumed to be center core 333 (or 1333), but the magnetic path forming elements that provide the magnetism suppressing elements may also be side cores 334 provided at the sides of exciting coil 331 that transect the magnetic path of arch core 332. According to this configuration, switching can be performed of the intensity of magnetic coupling between side cores 334 and heat-producing roller 310 corresponding to paper non-passage areas of heat-producing roller 310.

The fixing apparatuses according to the above-described embodiments are configured with exciting coil 331 serving as a magnetic flux generation section, center core 333, and so forth located outside heat-producing roller 310. A fixing apparatus with this kind of configuration allows ample space for installing center core 333 serving as the magnetic path forming element and its rotation section 500, and offers improved freedom of design for the body of the apparatus. Also, since a fixing apparatus with this configuration has magnetism masking members 701*a* and 701*b* located outside heat-producing roller 310, heat generated in magnetism masking members 701*a* and 701*b* is more readily dissipated by natural convection of the surrounding air. Moreover, forced circulation cooling by means of a fan can also be performed easily.

In the fixing apparatuses according to the above-described embodiments, since exciting coil 331 serving as a magnetic flux generation section, center core 333, and so forth are located outside heat-producing roller 310, working efficiency is good for the replacement or maintenance of parts such as consumable heat-producing roller 310.

The present application is based on Japanese Patent Application No. 2003-358023, filed on Oct. 17, 2003, the entire content of which is expressly incorporated herein by reference.

INDUSTRIAL APPLICABILITY

As described above, a fixing apparatus of the present invention can be configured compactly and can prevent an excessive rise in temperature of a paper non-passage area due to diverted flow of magnetic flux from a paper passage area of a heat-producing element to a paper non-passage area, and is therefore useful as a fixing apparatus of an electrophotographic or electrostatographic copier, facsimile machine, printer, or the like.

The invention claimed is:

1. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area; and a rotation section that causes said magnetism suppressing element to rotationally move to the masking position and to a withdrawal position, withdrawn from the masking positions, wherein said magnetic flux generator comprises an exciting coil that extends in a paper passage width direction of said heat-producing element and is wound so as to loop back at both edges of said heat-producing element, and a core that covers said exciting coil; and said magnetic path forming element comprises a center core located in the center of the windings of said exciting coil.

2. The fixing apparatus according to claim 1, wherein said magnetism suppressing element comprises a magnetism masking member formed from an electrical conductor that masks magnetic coupling between said magnetic flux generator and said heat-producing element corresponding to a paper non-passage area of said heat-producing element.

3. The fixing apparatus according to claim 1, wherein said heat-producing element comprises magnetic material.

4. An image forming apparatus comprising the fixing apparatus according to claim 1.

5. The fixing apparatus according to claim 1, wherein said core that covers said exciting coil has a bypass path section that forms a magnetic flux path so as to circumvent said center core on a side facing said heat-producing element with said center core therebetween.

6. The fixing apparatus according to claim 1, said magnetism suppressing element being movable to define to at least two masking positions that mask paper non-passage areas of different widths.

7. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area;

a rotation section that causes said magnetism suppressing element to rotationally move to the masking position and to a withdrawal position, withdrawn from the masking position; and a rotation section that rotates said magnetic path forming element, wherein said magnetism suppressing element comprises a cutaway part that increases a distance between an opposite surface of said magnetic path forming element facing a paper non-passage area of said heat-producing element and said heat-producing element and is provided in said magnetic path forming element.

8. The fixing apparatus according to claim 7, wherein said core that covers said exciting coil has a bypass path section that forms a magnetic flux path so as to circumvent said center core on a side facing said heat-producing element with said center core therebetween.

9. The fixing apparatus according to claim 7, an image forming apparatus comprising the fixing apparatus.

10. The fixing apparatus according to claim 7, said magnetism suppressing element being movable to define to at least two masking positions that mask paper non-passage areas of different widths.

11. A fixing apparatus comprising;

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area;

a rotation section that causes said magnetism suppressing element to rotationally move to the masking position and to a withdrawal position, withdrawn from the masking position; and a rotation section that rotates said magnetic path formimg element, wherein said magnetism suppressing element comprises a stepped part that has a width that varies in a rotational-direction width of an opposite surface of said magnetic path forming element facing a paper non-passage area of said heat-producing element and is provided in said magnetic path forming element.

12. The fixing apparatus according to claim 11, wherein said core that covers said exciting coil has a bypass path section that forms a magnetic flux path so as to circumvent said center core on a side facing said heat-producing element with said center core therebetween.

13. The fixing apparatus according to claim 11, an image forming apparatus comprising the fixing apparatus.

14. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area; and a rotation section that causes said magnetism suppressing element to rotationally move to the masking position and to a withdrawal position, withdrawn from the masking position, said magnetic flux generator comprising an exciting coil that extends in a paper passage width direction of said heat-producing element and is wound so as to loop back at both edges of said heat-producing element, and a core that covers said exciting coil;

said magnetic path forming element comprises a center core located in the windings of said exciting coil, wherein said core that covers said exciting coil has a bypass path section that forms a magnetic flux path so as to circumvent said center core on a side facing said heat-producing element with said center core therebetween.

15. The fixing apparatus according to claim 14, an image forming apparatus comprising the fixing apparatus.

16. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area; and a rotation section that causes said magnetism suppressing element to rotationally move to the masking position and to a withdrawal position, withdrawn from the masking position, wherein said magnetism suppressing element is provided on an endless belt rotatably suspended on said magnetic path forming element.

17. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area; and a rotation section that causes said magnetism suppressing element to rotationally move to the masking position and to a withdrawal position, withdrawn from the masking position, said magnetic flux generation section has generator comprises an exciting coil that extends in a paper passage width direction of said heat-producing element and is wound so as to loop back at both edges of said heat-producing element, and a core that covers said exciting coil; and said magnetic path forming element on which said magnetism suppressing element is provided comprises of a side core that is located on a side part of said exciting coil and transects a magnetic path of said core.

18. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area; and a rotation section that causes said magnetism suppressing element to rotationally move to the masking position and to a withdrawal position, withdrawn from the masking position, wherein said magnetic flux generator is provided externally of said heat-producing element.

19. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area; and a rotation section that causes said magnetism suppressing element to rotationally move to the masking position and to a withdrawal position, withdrawn from the masking position, wherein said magnetic flux generator comprises:

an exciting coil that extends in a paper passage width direction of said heat-producing element and is wound so as to loop back at both edges of said heat-producing element;

a core that covers said exciting coil; and a leakage magnetism masking member that is provided between said exciting coil and said core, and masks leakage flux that reaches said heat-producing element from said core via said exciting coil.

20. A fixing apparatus comprising:

a magnetic flux generator that generates magnetic flux;

a heat-producing element that is induction-heated by the generated magnetic flux;

a magnetic path forming element that is positioned opposite said heat-producing element and forms a magnetic flux path between said magnetic flux generator and said heat-producing element;

a magnetism suppressing element that is provided in said magnetic path forming element and is movable to a masking position, that masks at least part of the magnetic flux path corresponding to a paper non-passage area of said heat-producing element, between said magnetic path forming element and said heat-producing element, to suppress magnetic coupling between said magnetic path forming element and said heat-producing element in a region corresponding to the paper non-passage area;

a rotation section that causes said magnetism suppressing element to rotationally move to the masking position and to a withdrawal position, withdrawn from the masking position, an exciting coil that extends in a paper passage width direction of said heat-producing element and is wound so as to loop back at both edges of said heat-producing element;

a core that covers said exciting coil; and a leakage magnetism masking member that is provided between said exciting coil and said core, and masks leakage flux that reaches said heat-producing element from said core via said exciting coil, wherein a width, in the rotational-direction, of said heat-producing element of said leakage magnetism masking member is narrower than a width, in the rotational direction, of said heat-producing element of the exciting coil.

* * * * *